US007712262B2

(12) United States Patent
Scanlan

(10) Patent No.: US 7,712,262 B2
(45) Date of Patent: May 11, 2010

(54) REMOVABLE ARCH FORM ASSEMBLY AND METHOD OF INSTALLING

(76) Inventor: Tom Scanlan, 5150 Maritime Rd., Jeffersonville, IN (US) 47130

( * ) Notice: Subject to any disclaimer, the term of this patent is extended or adjusted under 35 U.S.C. 154(b) by 850 days.

(21) Appl. No.: 11/468,820

(22) Filed: Aug. 31, 2006

(65) Prior Publication Data

US 2008/0053012 A1 Mar. 6, 2008

(51) Int. Cl.

| | |
|---|---|
| ***E04C 3/02*** | (2006.01) |
| ***E06B 3/30*** | (2006.01) |
| ***E06B 1/04*** | (2006.01) |
| ***E06B 1/24*** | (2006.01) |
| ***E04G 15/02*** | (2006.01) |
| ***E04B 1/32*** | (2006.01) |

(52) U.S. Cl. ..... 52/86; 52/204.2; 52/211; 52/212; 52/204.53; 52/85; 52/87; 52/88; 52/89

(58) Field of Classification Search ..... 52/211, 52/731.7, 204.2, 212, 85–89, 204.53
See application file for complete search history.

(56) References Cited

U.S. PATENT DOCUMENTS

| | | | | |
|---|---|---|---|---|
| 451,572 | A | 5/1891 | Rankin Jr. | |
| 1,728,461 | A * | 9/1929 | Wolcott | 52/257 |
| 2,055,876 | A | 9/1936 | Newman | |
| 5,291,717 | A * | 3/1994 | Turner | 52/745.07 |
| 5,671,583 | A * | 9/1997 | Turner | 52/745.16 |
| 5,768,829 | A * | 6/1998 | Thompson et al. | 52/86 |
| 6,286,285 | B1 * | 9/2001 | Martell | 52/712 |
| 6,848,224 | B2 | 2/2005 | Bailey | |
| 2002/0152704 | A1 * | 10/2002 | Thompson et al. | 52/506.06 |
| 2005/0268569 | A1 * | 12/2005 | Teodorovich | 52/211 |
| 2006/0277840 | A1 * | 12/2006 | Bailey | 52/86 |

FOREIGN PATENT DOCUMENTS

| | | | |
|---|---|---|---|
| EP | 53456 | A2 * | 6/1982 |

* cited by examiner

*Primary Examiner*—Brian E Glessner
*Assistant Examiner*—Omar Hijaz
(74) *Attorney, Agent, or Firm*—James E. Cole; Middleton Reutlinger

(57) ABSTRACT

A removable arch form assembly for use in forming a masonry arch of a plurality of masonry elements on a substructure comprises a flexible arch form having a substantially rectangular shape, first and second end clips engaging an arched structure about which the masonry arch is to be formed, at least one intermediate clip positioned on the arched structure between the end clips and at an elevation differing from the end clips, the end clips and the at least one intermediate clip removably receiving the flexible arch form and retaining the form in an arched orientation.

21 Claims, 10 Drawing Sheets

REMOVABLE ARCH FORM ASSEMBLY AND METHOD OF INSTALLING

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates generally to masonry arch forms, and more particularly to a removable flexible masonry arch form assembly which may be removed after construction is complete.

2. Description of the Related Art

An arch is generally known as a structure for spanning an opening between two end points located at substantially equivalent elevations. Masonry arches are utilized in both residential and commercial facades and provide an aesthetically pleasing aspect to various types of architecture. Masonry arches may be formed to span various openings and are used in home and building construction to span radiused windows, doorways, or other arched structures providing an aesthetically pleasing appearance. The arch is architecturally significant because, in theory at least, it provides a structure which eliminates tensile stresses in spanning an open space. Masonry arches function by transferring vertical loads laterally to adjacent voussoirs and, thus, to the end points or abutments. All the forces are resolved into compressive stresses, which is useful because several of the available building materials such as brick, stone, and pre-cast concrete can strongly resist compression but are relatively weak when tension, shear or torsional stress is applied to them. By using the arch configuration, significant spans can be achieved. Further, the arch is a very useful structure as it is completely self-supporting since all of the compressive forces hold it together in a state of equilibrium.

Arches generally have end points or abutments which stabilize the arch and a keystone at a central, generally uppermost, location of the arch. Downward force in the arch causes thrust in the arch from the keystone to the abutments placing the arch in uniform compression. For purpose of this description, the arches are generally formed of masonry elements which may be understood to include brick, stone, precast concrete, terra cotta or other such material having good compressive strength and further comprising a mortar bonding material.

During installation of masonry arches, contractors generally utilize wooden sheets of plywood cut in an arch shape having a radius approximating the radius of the adjacent arched structure, for example window. This is time consuming because a separate wooden form must be cut for each window or arched structure as well as those structures with different radii. This type of construction wastes time and material since wood for forms must be purchased which would otherwise not be necessary for the project. Usually, the forms are discarded after construction and therefore must be made again for a subsequent construction project.

Other types of costly arch forming tools are utilized some of which are permanently installed in the building construction. Most regions, however, do not require such permanent construction and therefore it is preferred, for aesthetic reasons, to remove the arch form following the construction of the masonry arch. With many types of forming tools, this is not possible since the tool is permanently fastened to the substructure of the building before the masonry arch is formed over top of the structure.

Given the foregoing, it will be appreciated that a more affordable arch forming device is needed which may be removed following construction of the arch.

SUMMARY OF THE INVENTION

The present invention provides a removable arch form and method of installation.

According to a first aspect of this device, a removable arch form assembly for use in forming a masonry arch of a plurality of masonry elements on a substructure comprises a flexible arch form having a substantially rectangular shape, first and second end clips engaging an arched structure about which the masonry arch is to be formed, at least one intermediate clip positioned on the arched structure between the end clips and at an elevation differing from the end clips, the end clips and the at least one intermediate clip removably receiving the flexible arch form and retaining the form in an arched orientation. The first and second end clips further comprise a first leg having at least one fastening aperture. The first and second end clips further comprise second and third parallel legs, the second and third legs substantially perpendicular to the first leg and defining a space. The flexible arch form is positioned in said space. The removable arch form assembly further comprises a fixative disposed on a surface of said first leg of said end clips for positioning on the arched structure prior to fastening. The at least one intermediate clip has a first leg with a fixative disposed on a surface of said first leg for positioning on said arched structure. The first and second end clips further comprise at least one tab extending from one of a second leg and a third leg toward the other of the second leg and the third leg. The flexible arch form being removable after the masonry arch is formed about the arch form assembly. The end clips are a different size than said at least one intermediate clip.

According second aspect of this device, a removable arch form assembly, comprises a substructure, an arched structure attached to the substructure, a first end clip and a second end clip connected to at least one of the substructure or the arched structure adjacent a lowermost position of the arched structure, a flexible arch form removably engaging the first and second end clips, the first and second end clips having a tab to inhibit the flexible arch form from sliding downwardly therethrough. The first and second end clips further comprise a fixative disposed on a surface engaging the one of the substructure or the arched structure. The substructure is selected from the group consisting of plywood, wood sheets, studs, steel structures, TYVEK, fibrous sheet materials, drywall, concrete boards, insulation sheets, plastic sheeting, composite sheeting, other sheet materials or combinations thereof The removable arch form assembly further comprises at least one intermediate clip disposed between the first and second end clips and at a different elevation. The at least one intermediate clip removably receives the flexible arch form. The at least one intermediate clip further comprises a fixative material on a rear surface thereof The first and second end clip and the at least one intermediate clip each have a space for slidably receiving the flexible arch form. The end clips and the at least one intermediate clip each have at least two legs lo defining said space. The at least two legs engage upper and lower surfaces of said arch form. The removable arch form assembly further comprises at least one fastener extending through the end clips and the at least one intermediate clip. The at least one intermediate clip and the end clips being different sizes.

According to a third aspect of this device a removable arch form assembly comprises an arched structure having a ledge extending therefrom, a plurality of arch clips spaced apart from the ledge, the arch clip and the ledge defining a space, a flexible arch form disposed within the space, wherein the plurality of arch clips and the ledge capture the arch form and removably support the arch form.

According to a fourth aspect of this device, a method of installing a removable arch form assembly comprises fastening one of first and second end clips to at least one of an arched structure or substructure, fastening at least one intermediate clip to one of the at least one of the arched structure or substructure, fastening the other of the first and second end clips to the at least one of an structure or substructure, slidably connecting a flexible arch form to the one of the first and second end clips and the at least one intermediate clip, forming a masonry arch about the flexible arch form with a plurality of masonry elements, removing the flexible arch form after forming the arch form. The method further comprises affixing the first and second end clips adjacent ends of the arch form prior to the fastening. The method further comprises affixing the at least one intermediate clip between the first and the second end clips prior to the fastening of the intermediate clip.

According to a fifth aspect of this device a method of installing a removable arch form assembly comprises fastening a plurality of clips to a substructure, releasably engaging a flexible arch form with the plurality of clips, forming a masonry arch along the flexible arch form, removing the flexible arch form from the plurality of clips.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
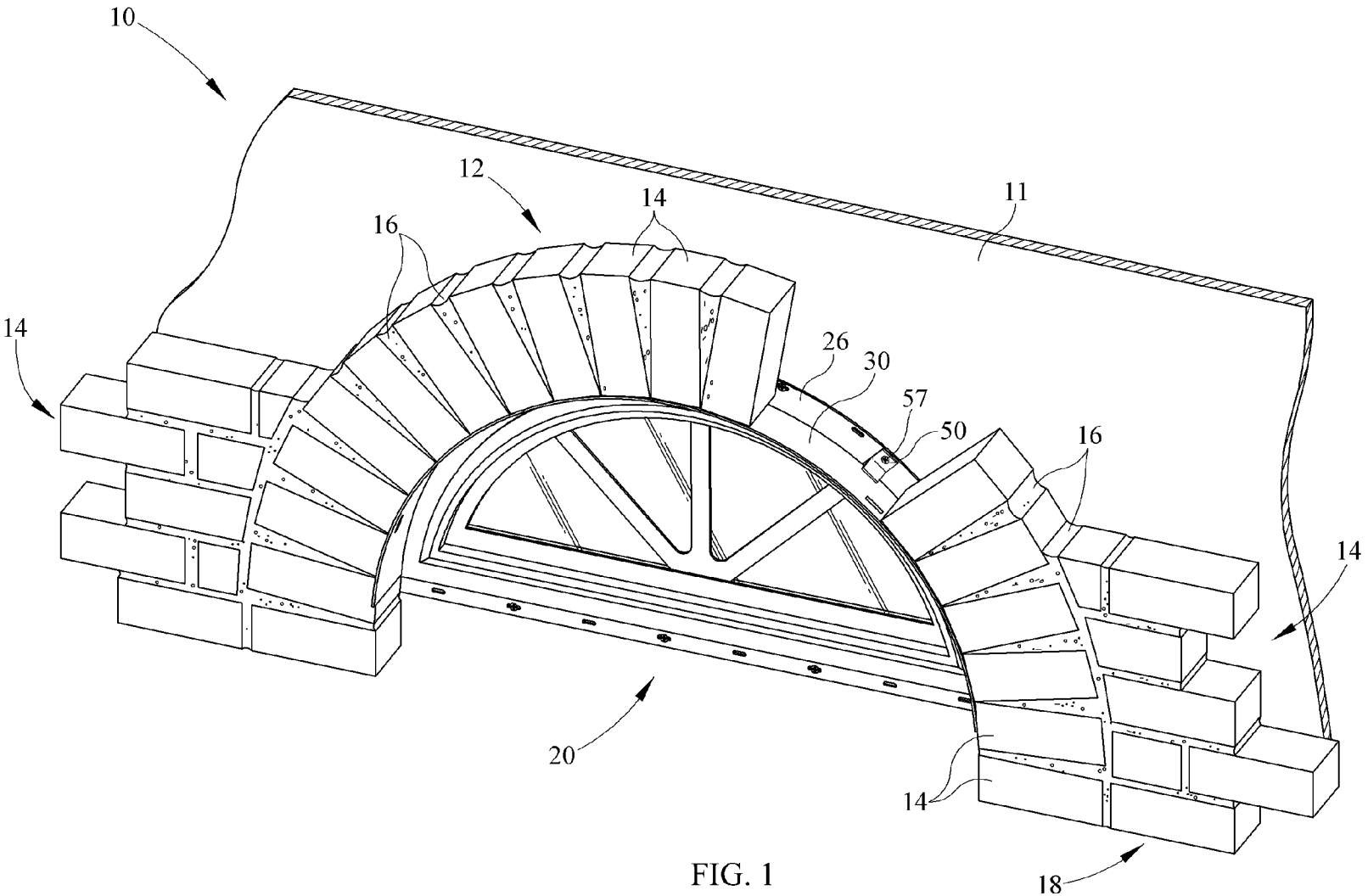
FIG. 1 is a perspective view of a partially constructed masonry arch utilizing the removable arch form of the present invention.

It should be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings. Furthermore, and as described in subsequent paragraphs, the specific mechanical configurations illustrated in the drawings are intended to exemplify embodiments of the invention and that other alternative mechanical configurations are possible.

Referring initially to FIG. 1, an arch formed assembly 10 is depicted in perspective view in a partially constructed masonry arch 12. The masonry arch 12 is comprised of a plurality of masonry elements 14, such as the bricks which are positioned in an exemplary soldier course arrangement. The masonry elements are generally rectangular in shape having two pairs of parallel longitudinal surfaces and two end surfaces which are substantially perpendicular to the two pairs of longitudinal surfaces. It should be understood that the longitudinal surfaces may be tapered forming an arch brick to further approximate the radius of the arch. In the soldier course arrangement, depicted in FIG. 1 and forming the masonry arch 12, the masonry elements or voussoirs 14 are turned on end so that an end surface of each of the masonry elements 14 is abutting the masonry arch form 10. A central keystone, which will be understood by one skilled in the art, may also be utilized in the central portion of the arch 12 and therefore is within the scope of the present invention. Additional masonry elements 14 are depicted adjacent the masonry arch 12 in a normal bond course arrangement to further define a building facade 18. The masonry elements 14 are separated by mortar 16 which connects the masonry elements 14 and hardens to retain the arch shape disposed about an arched structure 20, as depicted in the exemplary embodiment, arched doorway, arched window, circular or arched vent or the like which requires the use of a decorative masonry arch 12 to be positioned thereabout. The mortar 16 is known to one skilled in the art to be formed of cement, sand and water or other known construction materials.

Figure 2:
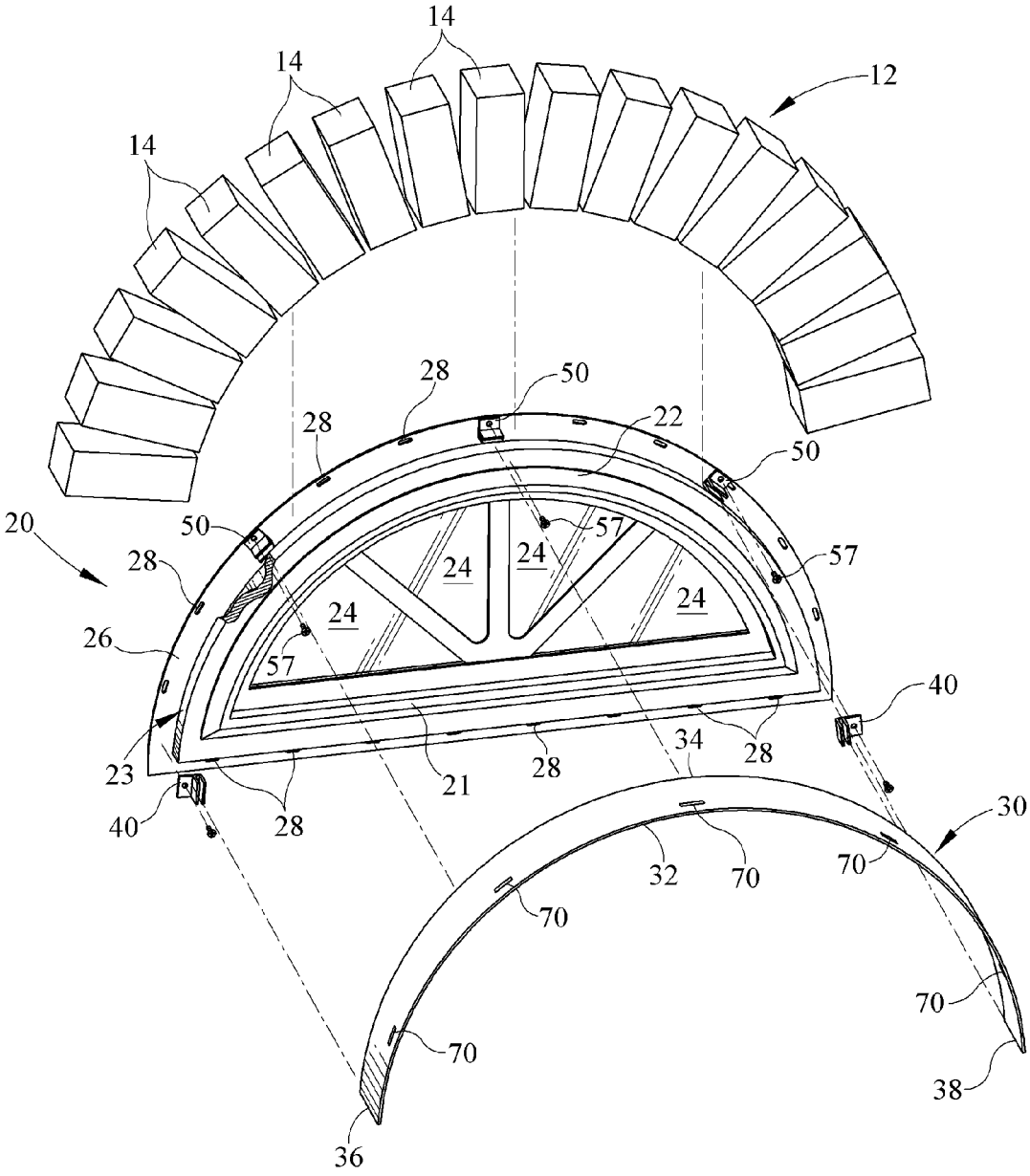
FIG. 2 is an exploded perspective view of the removable masonry arch form of the present invention.

Referring now to FIG. 2, an exploded perspective view depicts the arch form assembly 10 adjacent an arched window structure 20 and further includes the masonry arch 12 having the plurality of masonry elements 14 in the soldier course formation.

Figure 3:
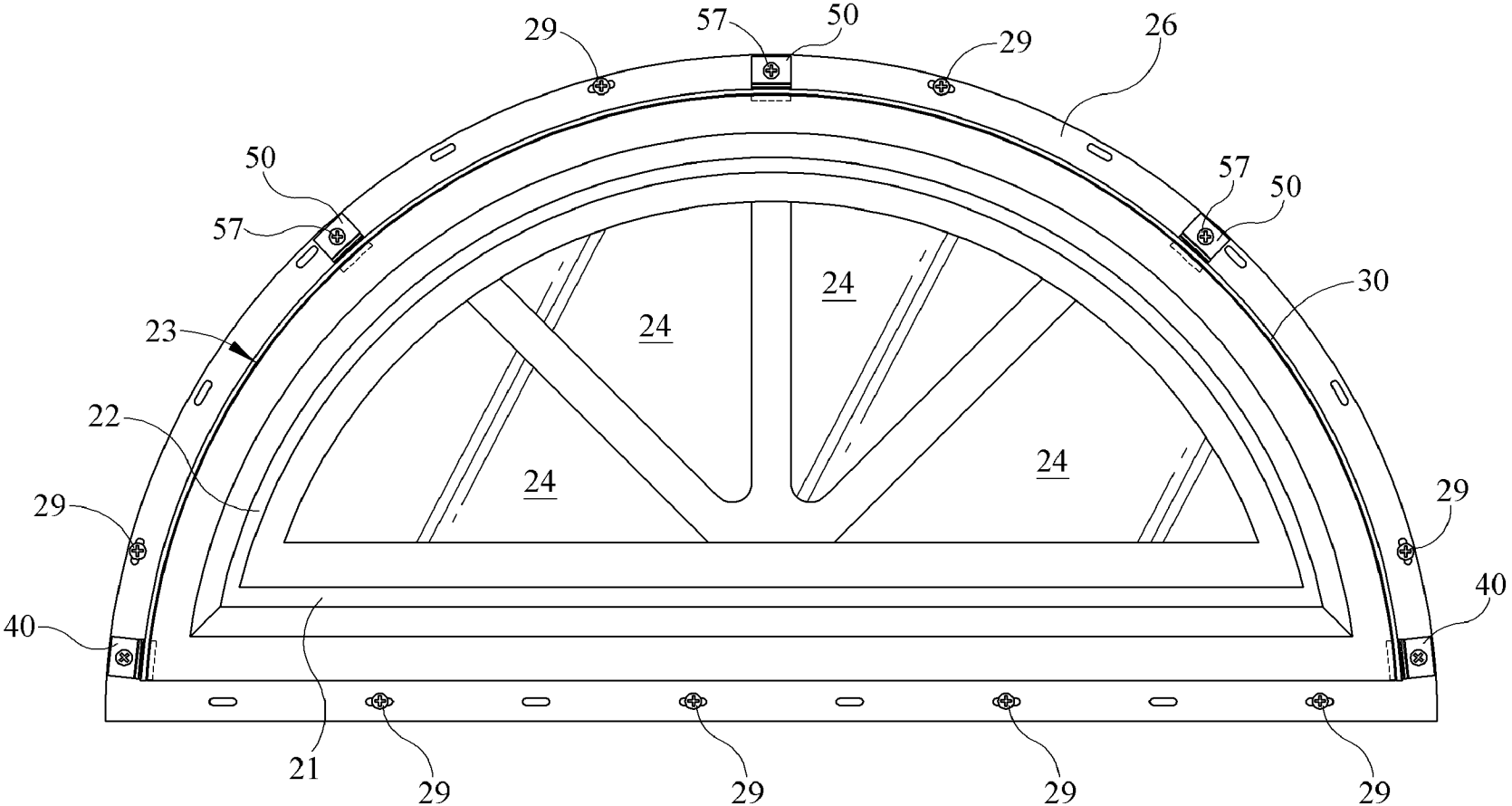
FIG. 3 is a front view of the assembled removable masonry arch form of the present invention.

The window 20 comprises a frame 21 including an arched frame portion 22. The frame 21 and arched frame portion 22 may be formed of wood, vinyl, aluminum or other material suitable for exposure to exterior weather elements. It should also be understood that the arched frame portion 22 about which the masonry arch 12 is formed may alternatively be adjacent an arched door structure or arched transom disposed above a door or normal quadrilaterally shaped window and therefore includes various structures having an arched portion about which a decorative masonry arch is desired. The window 20 is therefore only exemplary and may be substituted with various alternative equivalent structures. Within the boundary defined by the frame 21 and arch frame portion 22 is at least one window pane 24. The exemplary window 20 comprises four window panes 24 which define a substantially semi-circular shape. The panes 24 are separated by a plurality of support structures which may be decorative and are formed of materials similar to the frame suitable for exposure to exterior weather elements. Extending about the frame 21 and arched frame portion 22 is an attachment fin 26. The window attachment fin 26 connects to a substructure 11, such as plywood, wood sheets, studs, steel structures, in the case of a building having a metal sub-structure, TYVEK, fibrous sheet materials, drywall, concrete boards, insulation sheets, plastic sheeting, composite sheeting, other sheet materials or combinations of the like, by the plurality of fasteners 29 (FIG. 3) through fastening apertures 28 extending about the periphery of the attachment fin 26. The fasteners 29 may be nails, wood screws, self-tapping screws or other such fasteners depending on the substructure 11, as will be understood by one skilled in the art. The fin 26 and fasteners 29 may also be covered with a sealing plastic or flashing, not shown for clarity, as is known in the art prior to positioning and fastening of the clips 40 and 50.

Referring still to FIG. 2, the arch form assembly 10 comprises a flexible arch form 30, first and second end clips 40 and at least one intermediate clip 50 disposed between the first and second end clip 40. The arch form 30 is a planar generally rectangular elongate body having first and second parallel edges 32, 34 extending parallel to a major axis $A_{maj}$. (FIG. 4) of the arch form 30. The first and second edges 32, 34 are connected at ends by edges 36, 38 which are parallel to a minor axis $A_{min}$. (FIG. 4) of the arch form 30. The arch form 30 may be formed of sheet steel, an aluminum sheet, PVC or other similar structure sufficiently flexible to form the arch shape but also rigid enough to withstand the loading of the masonry elements 14. The arch form 30 is depicted in a curved configuration suitable for placement over the arched frame portion 22 of window 20. The arch form 30 is substantially flexible so that the flat form 30 may be deflected from a flat neutral position into an arched shape for installation. According to one exemplary embodiment, the arch form 30 is formed of 16 gauge steel, however, various thicknesses of metal may be utilized depending on the radius of the arched frame portion in the loading of masonry elements 14 to be disposed on the arch form 30. Alternatively, the arch form 30 may range from about 0.01 inch up to about 0.50 inch depending on the radius of the arch and materials to be supported. The arch form 30 is suitable for bending within the elastic range of the material so that the form 30 has a smooth curve shape generally free of sharp bends, unless the arched structure is defined by a point wherein a sharp bend is desirable. The flexible arch forms 30 may be formed in preselected lengths for known arch sizes, or maybe purchased in longer lengths for cutting to custom arch designs. For example, the arch forms 30 may come in pre-cut sizes of 4 feet, 8 feet and 12 feet or may come in intermediate or longer lengths for cutting at the construction site for custom sizes. As depicted in FIGS. 1 and 2, the arch form 30 may further comprise at least one grab 70 spaced along the length of the form 30, to aid in grasping and removal of the arch form 30 once the mortar 16 hardens and the arch 12 is formed. As depicted, the plurality of grabs 70 may be defined by a plurality of elements including apertures, ridges, creases, protuberances, slots, magnets, adhesives or equivalent structures to which a user may grasp by hand or with the aid of a tool for removal of the arch form 30. According to the embodiment depicted, the grabs 70 are substantially rectangular in shape and sized to receive a portion of a mason's hammer for easy removal of the form 30.

The first and second end clips 40 receive the ends of the arch form 30 so as to generally locate the end points of the arch form 30 relative to the arched frame portion 22 of the window 20. The end clips 40 of FIGS. 2-4 and 8-10 are generally depicted as being similar in size to the intermediate clips 50. Unless otherwise stated the distinction between end clips 40 and intermediate clips 50 is generally only the location of the clip relative to the arch form 30. However, the in alternate embodiments described herein the width of the clip 40 may differ from the intermediate clips 50. The end clips 40 support the flexible arch form 30 during construction and maintain the arched shape of the form 30. Further, the end clips 40 may be positioned at ends of the form 30 or intermediate the ends. Alternatively, the arch form 30 may be shorter than the arch 12 and therefore have end points where the masonry elements 14 begin needing support, rather than actual ends of the masonry arch 12. Thus, the end clips 40 may be positioned at or adjacent ends of the arch form 30 rather than ends of the masonry arch 12, which may be a different position. The end clips 40 are positioned adjacent a ledge or step 23 radially inside of the peripheral edge of the attachment fin 26. Specifically, the space between the ledge 23 and fin 26 receives a lower leg of the clips, described further herein, so that the lower leg of the clip generally extends between the fin 26 to the ledge 23. According to one aspect of the invention, the upper surface of the lower leg of the clip may be slightly above the upper surface of the ledge 23 so that the weight disposed on the arch form 30 is not transferred to the frame 22 of the arched structure.

Figure 4:
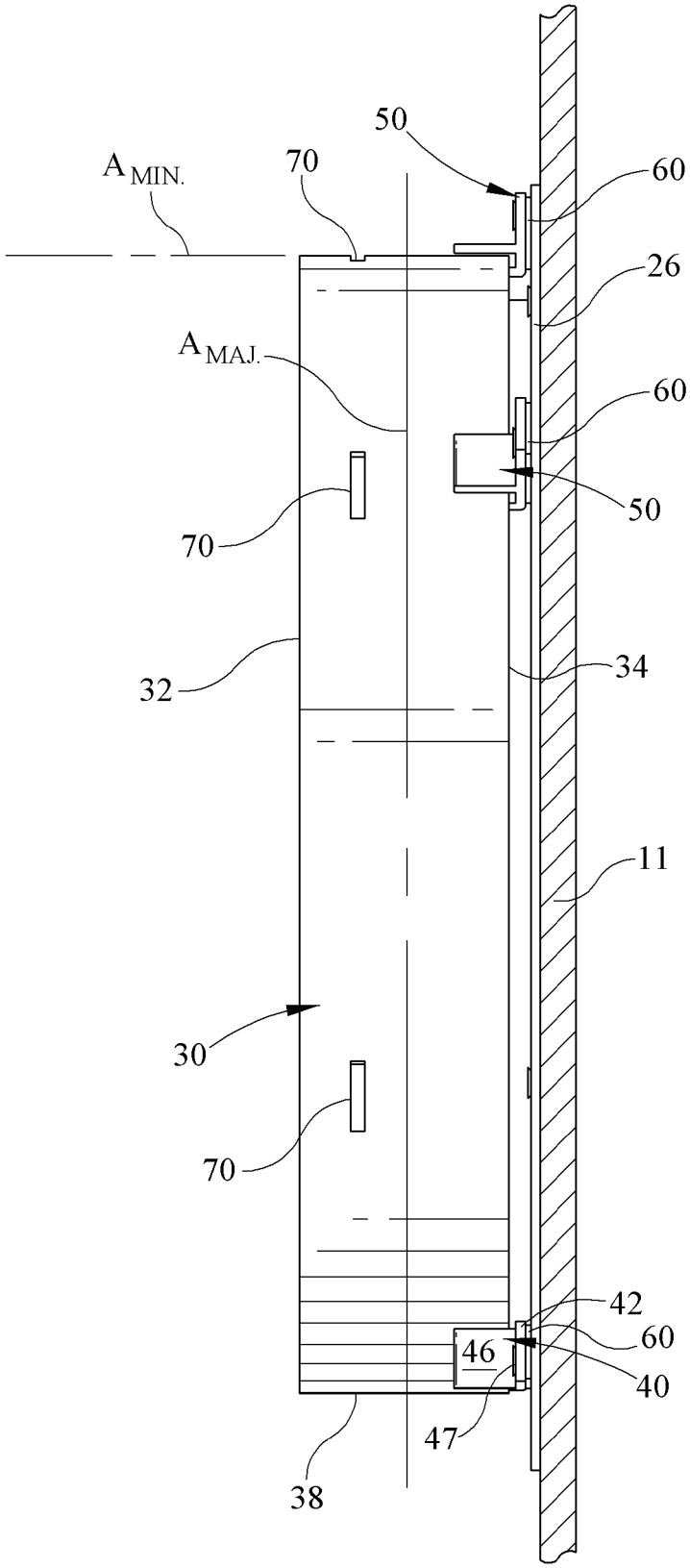
FIG. 4 is a side view of the assembled masonry arch form of the present invention.
Figure 5:
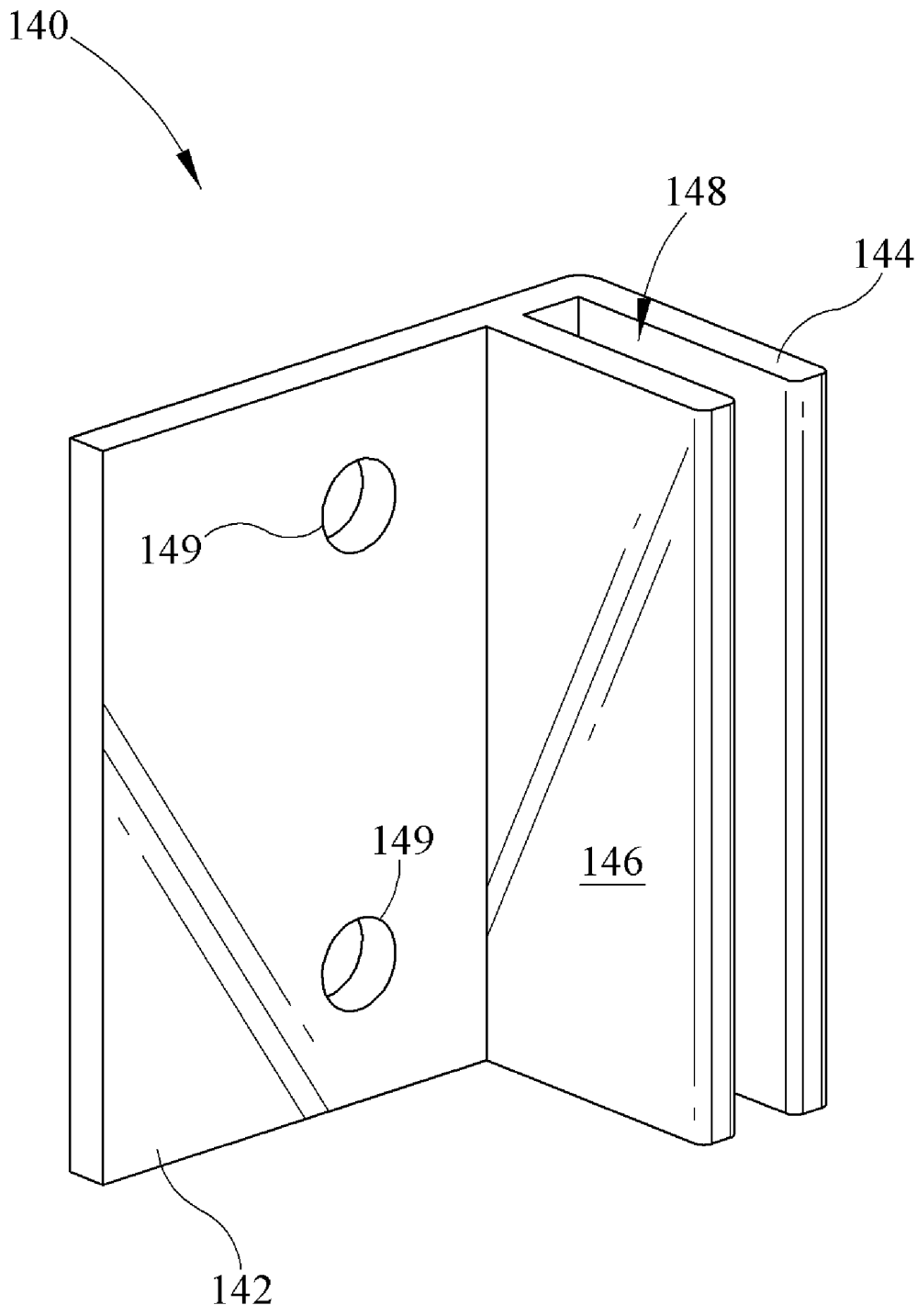
FIG. 5 is a perspective view of an end clip of the present invention.
Figure 6:
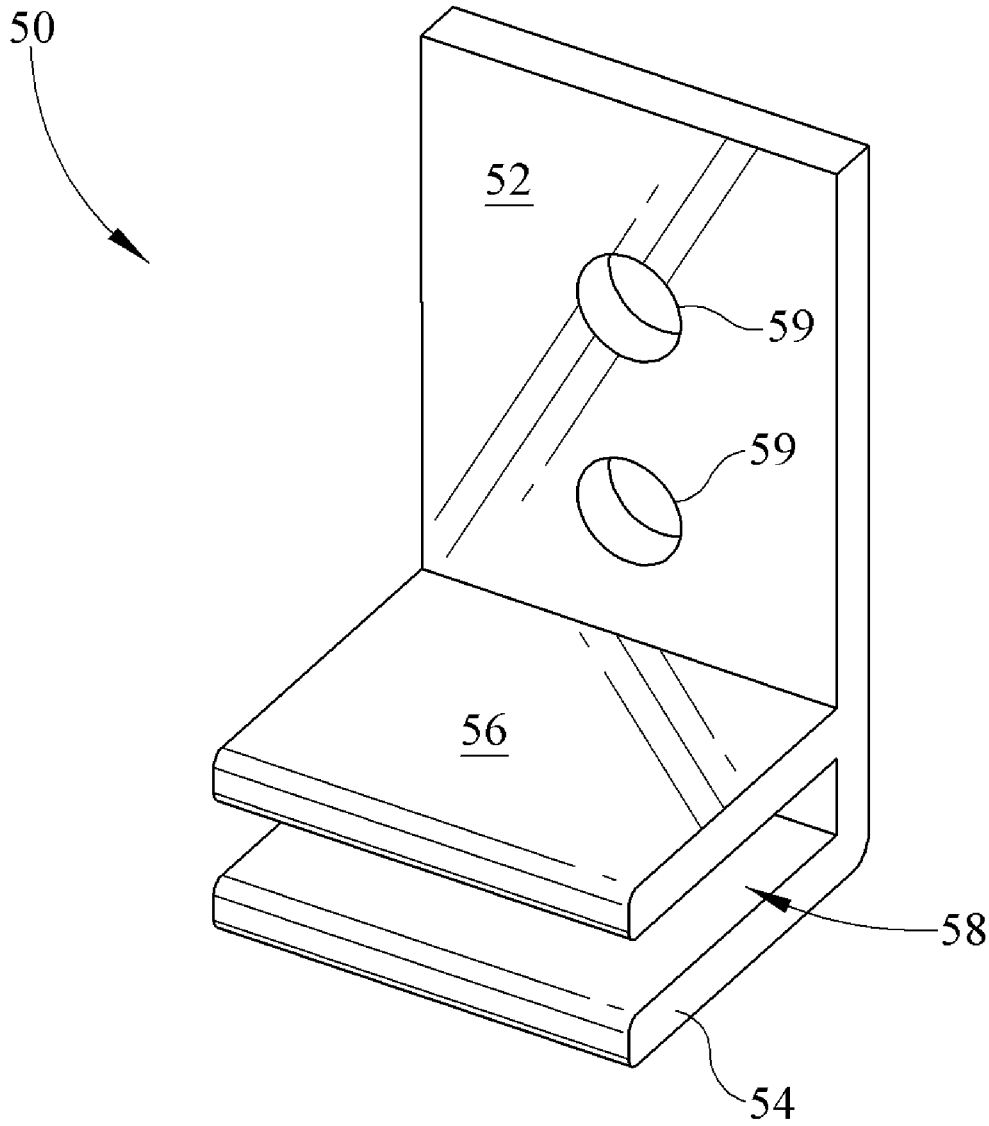
FIG. 6 is a perspective view of an intermediate clip.
Figure 8:
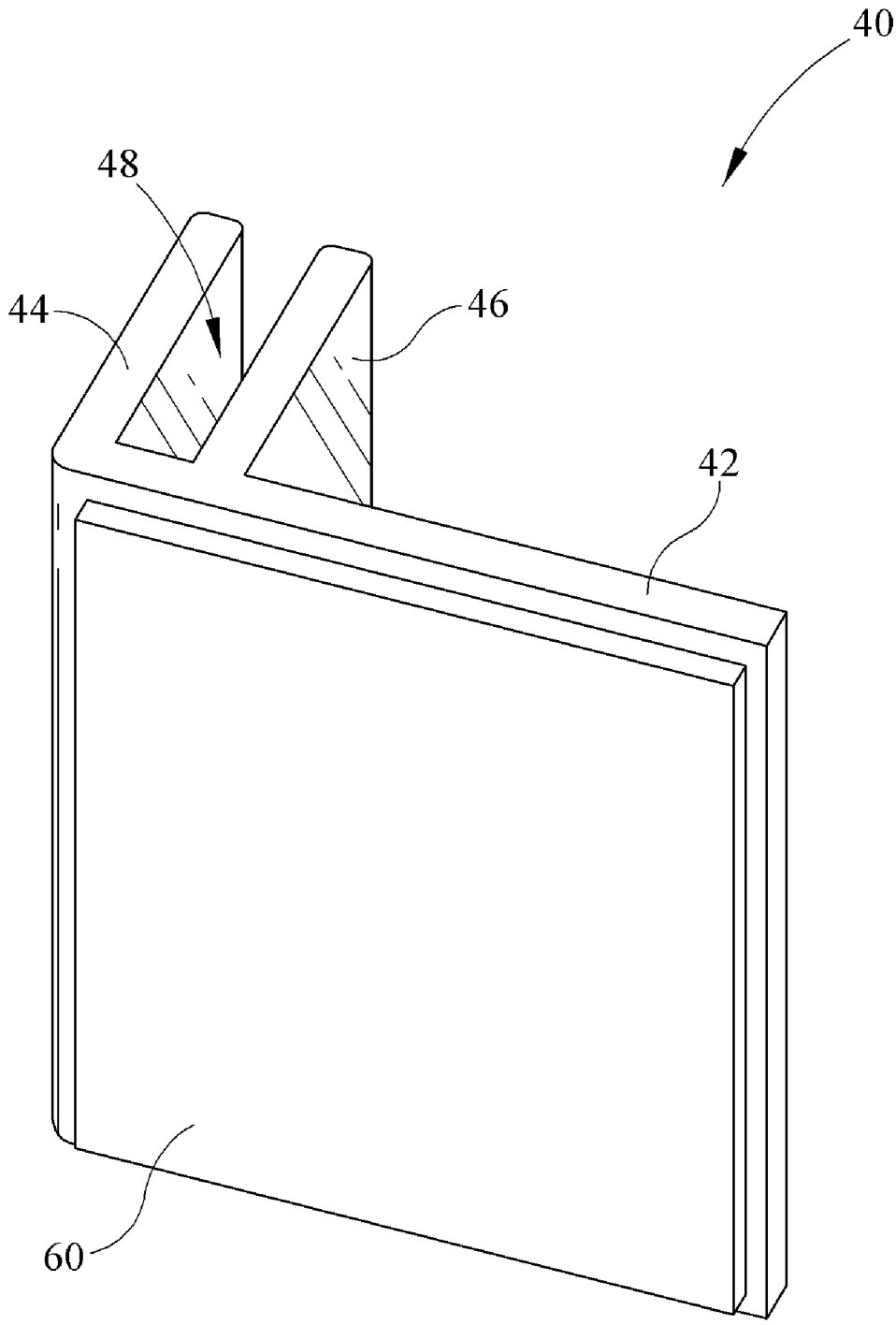
FIG. 8 is a rear perspective view of the end clip of FIG. 5, depicting the fixative material on the rear surface.

Referring now to FIGS. 8 and 5, an end clip 40 and alternative 140 are depicted respectively. In FIG. 5 a perspective view of the alternative end clip 140 is depicted comprising a first leg 142 and a second leg 144 which is substantially perpendicular to the first leg 142 and disposed generally at an end of the first leg 142. Parallel to the second leg 144 is a third leg 146 which is also perpendicular to the first leg 142. The alternative clip of FIG. 5 is used to describe both the clip 40 and the alternative 140 since the only difference is the height of the first leg 142 and the corresponding widths of the second and third legs 144,146. In other words, the height of the clip 140 as oriented in FIG. 5 is longer than the clip 40 shown in the FIGS. 2-4. The first, second and third legs 142, 144, 146 are depicted as rectangular in shape but it should be understood that various shapes may be utilized. The second leg 144 and third leg 146 define a space 148 wherein the flexible arch form 30 is slidably received. The first leg 142 further comprises at least one fastening aperture 149. The exemplary end clip 140 comprises first and second fastening apertures 149 which are utilized to connect the end clip 140 through the attachment fin 26. The end clips 40,140 may be formed of steel, aluminum, PVC or similar material.

Referring now to FIGS. 2-4, 6, and 8, the end clips 40 are fastened through the at least one fastening aperture 49 and through the attachment fin 26 into the sub-structure 11 of the building. Specifically, the exemplary embodiment depicts the second leg 44 disposed between the upper surface of the ledge 23 and the attachment fin 26 with the first leg 42 positioned against the fin 26. By positioning the second leg 44 adjacent to the ledge 23, and preferably such that the upper surface of the leg 44 is slightly above the upper surface of the ledge 23 formed in the window structure, and combined with the fact that the legs 44,46 or legs 54,56 are sized to fit between the ledge 23 and the attachment fin 26, the second leg 44, or leg 54, is generally hidden from the view of an observer viewing the window structure 20, as shown in FIG. 1. However the second legs 44 are depicted in broken line in FIG. 3 behind the ledge 23. The end clips 40 are arranged so that the second and third legs 44, 46 are generally vertically positioned and so that the space 48 is also substantially vertically arranged and extending outwardly from the arched structure 20. Alternatively, the arch 30 may not be a full semi-circular shape and therefore the end clips 40 may not be vertically oriented. In any construction, the space 48 should be generally oriented tangentially adjacent the curvature of the window arch 22. It should be noted that although the end clips 40 are shown fastened through the attachment fin 26. However, according to one alternative embodiment, the end clips 40 may be fastened directly to the sub-structure 11 at a position which is adjacent the attachment fin 26 but not extending therethrough so that the masonry elements 14 are adjacent the arched structure 20. Otherwise stated, the fasteners may extend directly through the sub-structure 11 rather than through the fin 26.

As depicted the first leg 42 is positioned against either the attachment fin 26 or against the building sub-structure adjacent the window 20. The rear surface of the first leg 42 may further comprise a fixative material 60, as depicted in FIG. 8, which adheres the end clips 40 in a position and orientation for fastening through the at least one fastening aperture 49. In addition to adhering and holding the end clips 40 in position for fastening, the fixative 60 may also have sealing characteristics for sealing the at least one aperture formed by the fasteners 47,57 extending through clips 40,50 and through waterproofing flashing (not shown for clarity) positioned over the attachment fin 26 and/or the sub-structure 11. Since the end clip 40 may be fastened through the flashing and attachment fin 26, at least one aperture is formed in the flashing through which moisture and/or dirt may pass through and into the sub-structure 11 of the building. Moisture passing around a fastening aperture for fastening the clips 40,50 may lead to mold, dirt and insects within the wall of the building and is highly undesirable. Accordingly, the fixative material 60 may also seal the puncture in the flashing caused by the fastener thereby inhibiting moisture from passing behind the end clip and through the window attachment fin 26. The fixative may be in the form of a gelatinous material spread on the clips 40 and 50 or, as shown, may be a stick-on affixed to the clips 40,50 and ready to adhere to the substructure 11, attachment fin 26, or flashing disposed over the attachment fin 26. Alternatively, the fixative 60 may comprise a rubberized or cushioning sealing material or gasket with an adhesive glue material on both sides of the sealing gasket inhibits water penetration. It should be understood by one skilled in the art that the fixative material 60 may also be positioned on intermediate clips 50 for use therewith. The fixative 60 covers the apertures 49 and 59 so that the punctures caused by the fasteners 47,57 passing through clips 40,50 and into the substructure 11, attachment fin 26 or flashing over the fin 26 are sealed.

Figure 7:
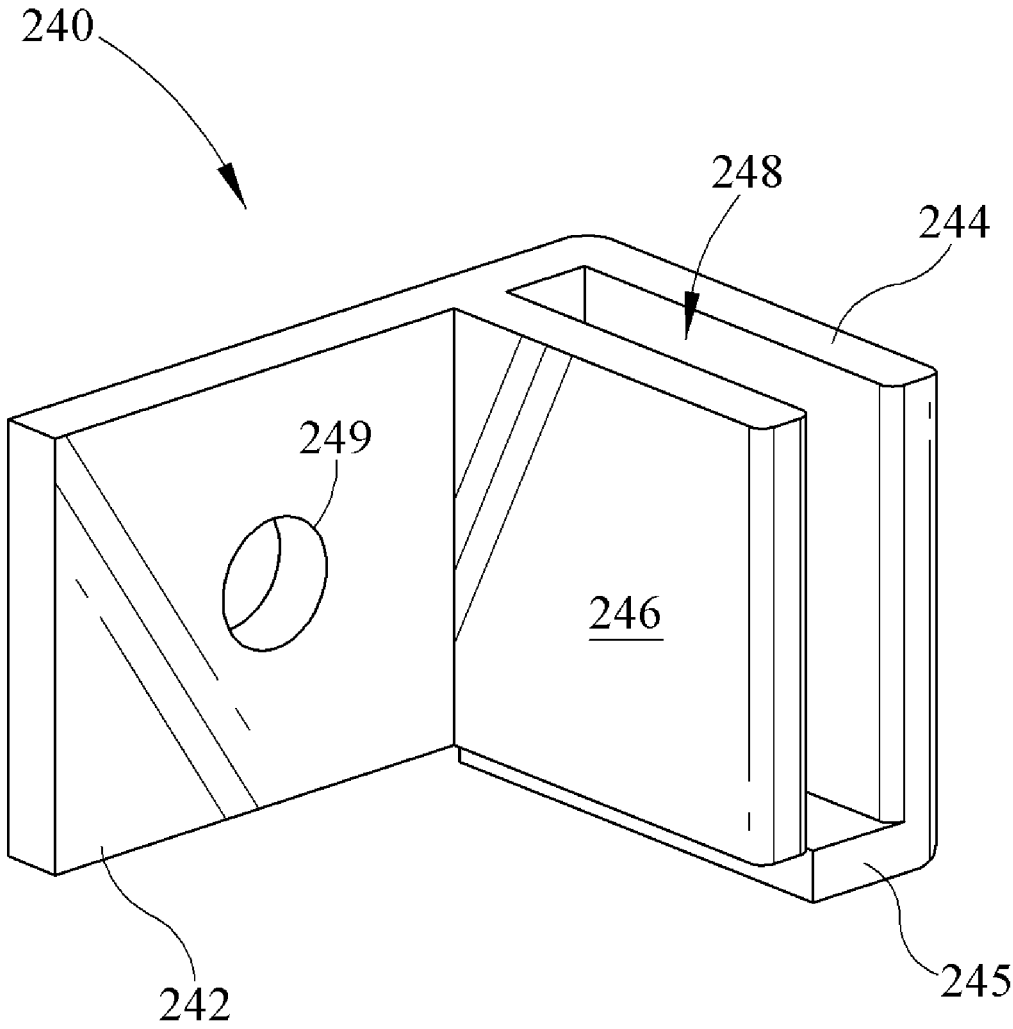
FIG. 7 is a perspective view of an alternative end clip which may be utilized with the present invention.

Referring now to FIG. 7, a further alternative embodiment of the end clip 240 is depicted. According to the instant embodiment, the end clip 240 includes a first leg 242, a second leg 244 and a third leg 246. The first leg 242 includes a fastener aperture 249 for fastening the clip 240 to an arched structure or substructure (not shown). A space 248 is defined between the second leg 244 and the third leg 246. A tab 245 is connected to one of the second leg 244 or third leg 246. The tab 245 is positioned at a lower end of the second leg 244 or third leg 246 when the end clip 240 is positioned for use on or adjacent the window attachment fin 26. The tab 245 may receive the ends 36, 38 of the flexible arch form 30 to inhibit the form 30 from moving downward when loaded with masonry elements 14. Accordingly, this alternate end clip 240 may be used with or without the at least one intermediate clip 50 described herein. Further, it should be understood that the end clip opposite the end clip 240 depicted in FIG. 7 will comprise a tab 245 at the opposite end (upper end) of the second or third leg 144,146 since the opposite clip will be rotated for proper orientation, relative to that shown in FIG. 7.

Referring again to FIG. 2, the arch form assembly 10 further comprises at least one intermediate clip 50. The intermediate clip 50 is depicted as being positioned on the attachment fin 26 of the arched window 20. The at least one intermediate clip 50 is positioned between the end clips 40 and at a different elevation to approximate the arch shape of the frame portion 22. In the exemplary embodiment three intermediate clips 50 are utilized to approximate the arch of the frame portion 22, however, the number of intermediate clips 50 and spacing may vary depending on the radius of the arched frame portion 22 and the weight of the masonry elements 14 being utilized. The intermediate clips 50 may be formed of a material similar to the end clips 40 and flexible arch form 30 for reasons previously indicated. The intermediate clip 50 is similar to the end clip 40 and may be distinguished by the location of the clip relative to the arch form 30 or masonry arch 12. In other words, the end clips are located at or adjacent ends of the form 30 or arch 12 whereas the intermediate clips 50 are generally positioned between the end clips 40. Thus, although the shapes of the end clips 40 and intermediate clips 50 are shown as different, as previously described it is well within the scope of the present invention that they may be the same shape.

Referring now to FIGS. 2-4 and 6, the at least one intermediate clip 50 comprises a first leg 52 and a second leg 54 disposed perpendicular to the first leg 52 near an end of the first leg 52. Extending perpendicular to the first leg 52 and parallel to the second leg 54 is a third leg 56 which, in combination with the second leg 54, defines a space therebetween. Within the space 58, the flexible arch form 30 is removably received. The first leg 52 is positioned against the attachment fin 26 or a sub-structure 11 for fastening through at least one aperture 59. Similar to the end clip 40, the rear surface of the first leg 52 may comprise a fixative material 60 (FIG. 8) which allows for the intermediate clip 50 to be positioned and oriented prior to fastening to the substructure 11. With the fixative material holding the intermediate clip 50 in place, the installer may use both hands to place a fastener through the at least one aperture 59 and fasten the clip 50 to either the attachment fin 26 or the sub-structure 11 behind the window 20. The fixative material 60, as previously described, also performs a sealing function so that a puncture in the waterproofing flashing and attachment fin 26 and/or substructure 11 by the fastener 57 is adequately sealed to inhibit moisture and dirt penetration through the intermediate clip 50 and into the substructure 11. The space 50 between the second leg 54 and third leg 56 is dimensioned to slideably receive the arch form 30 so that the flexible arch form 30 may be installed prior to formation of the masonry arch 12. Alternatively, the intermediate clip 50 may be positioned adjacent the attachment fin 26 and connected directly into the sub-structure 11 of the building by lengthening the clip 50 so that the fastening apertures 59 are not positioned over the attachment fin 26. Similar designs may be utilized for end clips 40. Further, the second and third legs of the at least one intermediate clip 50 and the end clips 40 may be tapered to engage the upper and lower surface of the arch form 30 and or may include protuberances to engage such surfaces, but not the edge of the rearward edge of the arch form 30. However, such design should allow removal of the flexible arch form 30 following construction of arch 12. As indicated in FIG. 4, a slight gap is provided between the edge 34 and first legs 42 and 52 of end clips 40 and intermediate clips 50 so as to ease removal of the arch form 30 from the clips 40,50. Thus the end clips 40 and intermediate clips 50 engage the upper and lower surfaces of the arch form 30 rather than edges thereof.

Referring now to FIGS. 1-7, the arched structure 20 is positioned on and fastened to a building sub-structure 11 through fastening apertures 28. Such sub-structure 11 may include plywood, wood sheets, studs, steel structures, in the case of a building having a metal sub-structure, TYVEK, fibrous sheet materials, drywall, concrete boards, insulation sheets, plastic sheeting, composite sheeting, other sheet materials or combinations of the above elements. Next, the end clips 40 are positioned such that the space 48 of each clip is oriented for receiving the form 30 and the fastening apertures 49 are positioned on or adjacent to the window attachment fin 26 or over the waterproof flashing disposed on the fin 26. The end clips 40 are affixed with the fixative material 60 in the correct position and orientation so that the clips 40 maintain this proper orientation and position which allows an installer to have two free hands for installing the fasteners 47 through the at least one fastening aperture 49. Further, the lower legs of the clips 40,50 are positioned to be generally at about a height of the ledge 23. Various types of fasteners 47, 57 may be utilized such as nails, wood screws, self-tapping screws or the like. It should be understood that one or both end clips 40 may be initially installed. For example, if both end clips are installed initially, it would be preferable that the form 30 be sized to properly fit therebetween with little or no overhanging portions, especially if end clips 240 are utilized. However, if one end clip 40 is installed initially, the intermediate clips 50 may be installed moving from away from the first end clip 40 to form the assembly 10 until reaching the position for the second opposite end clip 40. As a further alternative, an intermediate clip 50 may be installed at or near the top of the arch and then the additional clips 50 may be added until reaching the position for the end clips 40. As the fasteners 47,57 are installed, the lower legs 44,54 raise slightly from their affixed elevation, due to the thickness of the fixative 60, so that the upper surface of legs 44,54 are slightly higher than the upper surface of ledge 23. This inhibits weight of the masonry arch 12 from being transferred to the arched structure 20.

After positioning the clips 40,50, next the clips are secured by positioning fasteners 47,57 through the end clip 40 and the intermediate clip 50 to connects the clips 40,50 to the sub-structure 11 through the attachment fin 26. It should be understood, however, that the present assembly may be installed in the manner wherein all of the clips 40 and 50 are affixed and after which the clips 40,50 are all fastened. Alternatively, each clip 40,50 may be affixed and fastened at the same time moving along the periphery of the arch. The arch formation of clips 40,50 may be formed by starting at one end of the arch and working toward the opposite end or may be formed by starting in the middle and working outward to the ends. Further, it should be understood that while the clips 40,50 are fastened to the arched window, doorway or other substructure as previously recited, the sealing fixative 60 may be engaging a sealing flashing positioned over the attachment fin 26, as will be understood by one skilled in the art.

After each intermediate clip 50 is properly installed, the edge 36 or 38 of flexible arch form 30 is positioned within the space 48 of one end clip 40 at space 48 and then positioned into each of the at least one intermediate clip 50 at space 58. The edge of the arch form 30 is inserted into the space defined by the clips 40,50 but the form 30 is retained by the engagement of the upper and lower surfaces of the arch form 30 with the clips 40,50, rather than any edge of arch form 30. It may be desirable that an installer feed the arch 30 through the clips 40 and 50 and locate the end position of the form 30 before attaching the final end clip 40, as will be understood by one skilled in the art. However, it is within the scope of the present invention that the arch form 30 extend beyond the end clip positions. As previously described, according to one embodiment the present device may be utilized without intermediate clips 50 when the masonry elements 14 are only placing a light load on the arch form 30. The end clips 140 may be used where additional stability is required. Once the arch form 30 is properly positioned and formed around the arched frame portion 22, the masonry elements 14 may be positioned along the outermost surface of the arch form 30 and adjacent the window attachment fin 26 to form the masonry arch 12 while maintain an airgap between the masonry elements 14 and the sub-structure 11. During installation of each of the plurality of masonry elements 14, mortar 16 is disposed between the masonry elements 14 until the arch 12 is fully formed. After the mortar sets, the arch 12 is self-supporting and the arch form 30 may be slideably removed from the end clips 40 and at least one intermediate clip 50.

According to a further aspect of the invention, an arched structure 20 may be utilized having a large radius requiring more than one arch form to extend around the periphery of the structure 20. In such circumstance, it may be desirable to utilize two or more arch forms 30 to extend around the arch structure 20, as opposed to the one long arch form which is unwieldy and difficult to mount. Accordingly, an installation may be performed as described above by affixing a first end clip 40 and each of intermediate clips 50 followed by fastening each of the clips 40,50 in place. The end position of the first arch form 30 should be located by positioning the first arch form 30 in position within the first end clip 40 and intermediate clips 50. At the second end position of the first arch form 30, a clip 40, 50, or 140 may be positioned so as to receive a second end of the first arch form 30 and a first end of a second arch form 30. From this position, the process is continued to the second end of the second arch form 30 where a second end clip 40 is positioned. Because of the wider design of end clips 140, as shown in FIG. 5, it may be desirable to position such clip 140 between the second end of the first arch form and first end of the second arch form 30. However, intermediate clips 50 may also be utilized. Thus the term end clip may be understood as referencing the end of the arch forms, the end of the masonry arch, or ends of the plurality of aligned clips but is merely a locational distinguisher and may be the same shape as the intermediate clip, as discussed throughout this disclosure.

Figure 9:
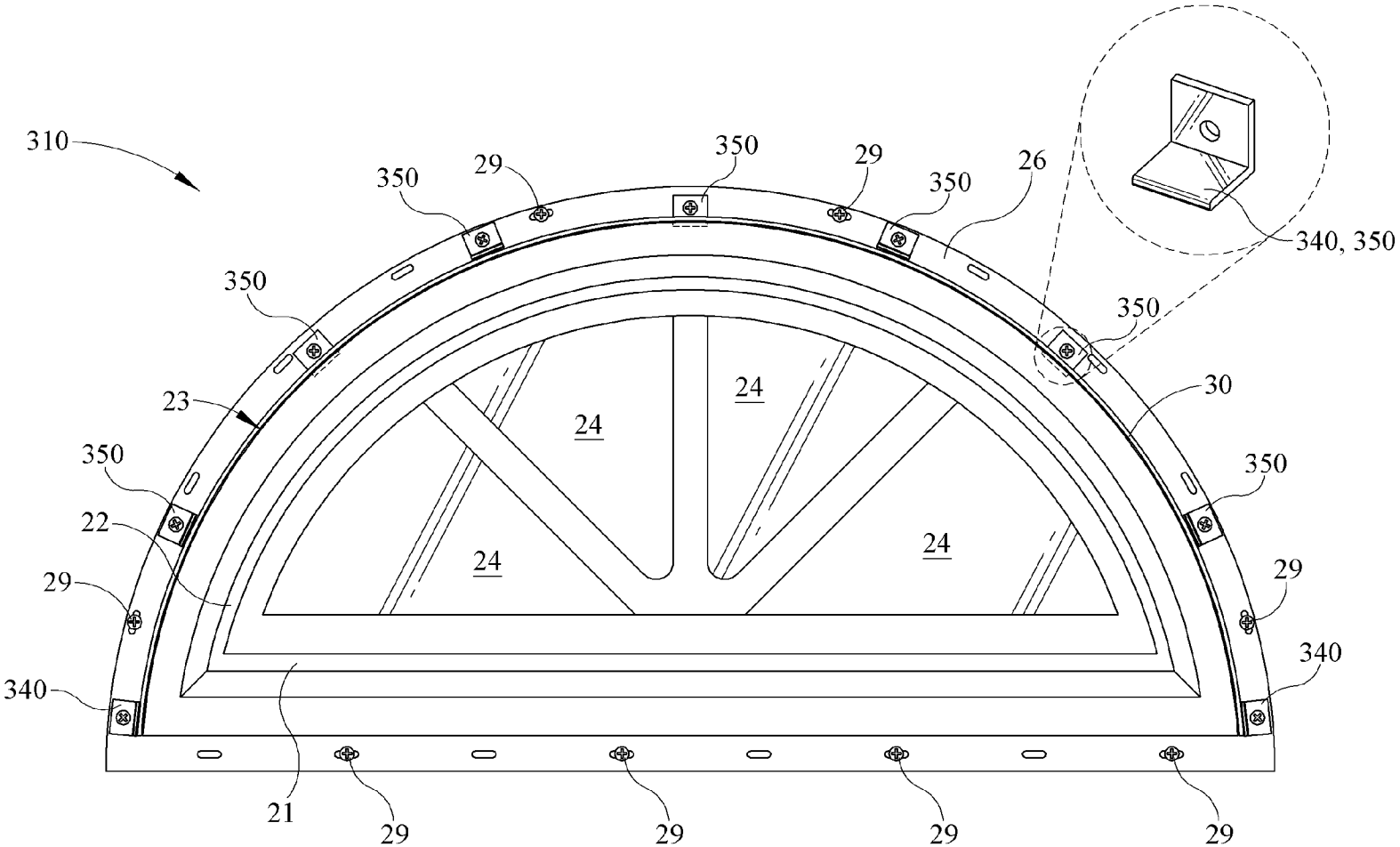
FIG. 9 is a front view of an alternative embodiment of the present invention having an alternate clip design and arrangement to support the removal arch form; and, FIG. 10 is a front view of an arch form assembly which utilizes a window structure surface to stabilize the arch form.

Referring now to FIG. 9, a further aspect of the removable arch form assembly 310 comprising an alternative clip design. According to this embodiment, the end clips 340 and intermediate clips 350 are substantially L-shaped. In order to provide proper support for the arch form 30, the clips 340,350 may be alternately positioned against the upper and lower surfaces of the arch form 30 around the radius of the arched structure 20. In constructing this arch form assembly 110 an installer may begin at one end of the form 30 and installing the clips 340, 350 moving from one end to the other before positioning the arch form 30 there between. In this configuration, the clips 340,350 are radially offset, by about the thickness of the arch from 30 so as to alternate along the upper and lower surfaces of the arch form 30. The clips supporting the lower surface of the arch form 30 are positioned such that the lower supporting leg of the L-shaped clips are located substantially equivalent to the upper surface of the ledge 23, and further such that the upper surface of lower supporting leg is slightly above the upper surface of the ledge 23. Those legs are shown in broken line behind the ledge 23. The upper clips are radially offset from the lower clips by the thickness of the arch form 30. Once installed, the form 30 is captured between the clips 340,350 on the upper and lower surfaces of the arch 30. Regardless of the method of construction, the embodiment depicts the arch form 30 removably captured and supported on top and bottom surfaces between the clips 340,350.

Figure 10:
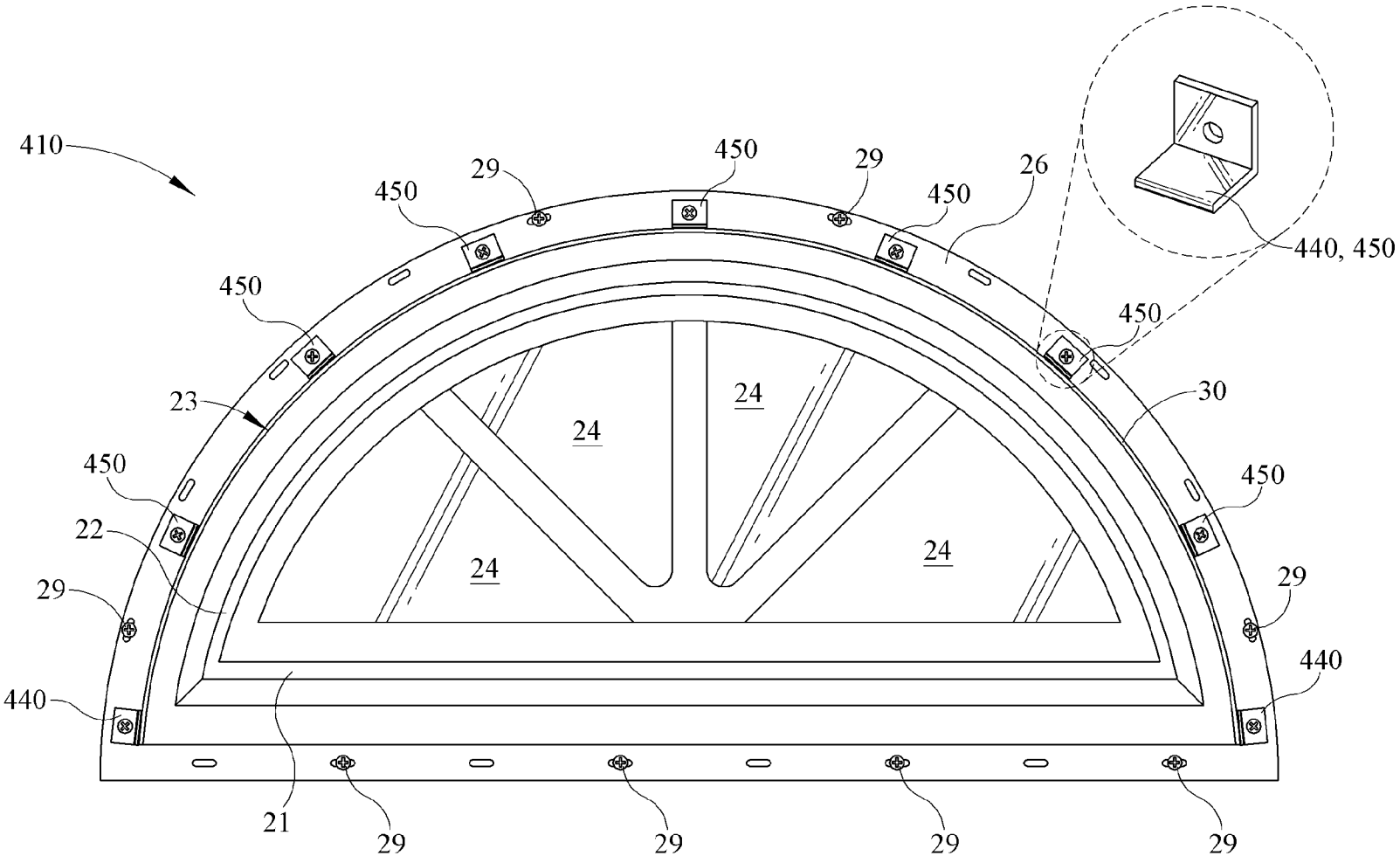

Referring now to FIG. 10, an additional aspect of the removable arch form assembly 410 is depicted. According to this embodiment, the end clips 440 and intermediate clips 450 are all spaced apart along the upper surface of the arch from 30. The arch form 30 is not supported below by intermediate clips in the alternating fashion shown in FIG. 9 but instead is supported along the lower surface by the step or ledge 23 extending substantially perpendicularly from the window fin 26. Otherwise stated, the lower surface of the arch 30 is supported by the step or ledge 23 of the window structure while the upper surface of the arch form 30 is captured between the plurality of clips 440, 450. It should be understood that the end clips 340 may be the same size as the intermediate clips 350 or may be wider than the intermediate clips 350 as previously described. Further, it should be understood that the installation shown in FIG. 10 may occur in various manners described previously in this disclosure.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A removable arch form assembly for use in forming a masonry arch of a plurality of masonry elements on a substructure, comprising:

a flexible arch form having a substantially rectangular shape;

first and second end clips independently formed and separately disposed about an arched structure about which said masonry arch is to be formed;

each of said first and second end clips having a first leg and second and third legs extending from said first leg, said second and third legs defining said a space, said space having an opening oriented away from said substructure to removably receive said flexible arch form through said opening and in said space;

at least one intermediate clip separately disposed from said first and second end clips about said arched structure between said end clips and at an elevation differing from said end clips and retaining said arch form in an arched orientation;

said flexible arch form having a grab to slidably remove said flexible arch form from said first and second end clips and said at least one intermediate clip after said masonry arch is formed.

2. The removable arch form assembly of claim 1, said first and second end clips further comprising at least one fastening aperture.

3. The removable arch form assembly of claim 2, said second and third legs being parallel, said second and third legs also being substantially perpendicular to said first leg and defining said space.

4. The removable arch form assembly of claim 2 farther comprising a fixative disposed on a surface of said first leg of said end clips for positioning on said arched structure prior to fastening.

5. The removable arch form assembly of claim 1, said at least one intermediate clip having a first leg with a fixative disposed on a surface of said first leg for positioning on said arched structure.

6. The removable arch form assembly of claim 1, said first and second end clips further comprising at least one tab extending from one of a second leg and a third leg toward the other of said second leg and said third leg.

7. The removable arch form assembly of claim 1, said end clips being a different size than said at least one intermediate clip.

8. The removable arch form assembly of claim 1, said at least one intermediate clip and said end clips being the same size.

9. A removable arch form assembly, comprising:

a substructure;

an arched structure attached to said substructure;

a first end clip and a second end clip independently formed and separately connected to at least one of said substructure or said arched structure adjacent a lowermost position of said at least one of said substructure or said arched structure;

said first and second end clips each having a first leg, a second leg and a third leg, said second and third legs extending from said first leg and defining an opening, said second and third legs extending away from said substructure and said arched structure;

a flexible arch form removably engaging said first and second end clips through said opening;

said first and second end clips having a tab to inhibit said flexible arch form from sliding downwardly therethrough;

further comprising a first configuration wherein said arch form is temporarily positioned within said openings of said first and second end clips and a second configuration wherein said arch form is slidably removed from said first and second end clips after an arch is formed about said arched structure.

10. The removable arch form assembly of claim 9, said first and second end clips further comprising a fixative disposed on a surface engaging said one of said substructure or said arched structure.

11. The removable arch form assembly of claim 9, said substructure selected from the group consisting of plywood, wood sheets, studs, steel structures, TYVEK, fibrous sheet materials, drywall, concrete boards, insulation sheets, plastic sheeting, composite sheeting, other sheet materials or combinations thereof.

12. The removable arch form assembly of claim 9 further comprising at least one intermediate clip disposed between said first and second end clips and at a different elevation.

13. The removable arch form assembly of claim 12, said at least one intermediate clip removably receiving said flexible arch form.

14. The removable arch form assembly of claim 12, said at least one intermediate clip further comprising a fixative material on a rear surface thereof.

15. The removable arch form assembly of claim 12, said first and second end clip and said at least one intermediate clip each having a space for slidably receiving said flexible arch form.

16. The removable arch form assembly of claim 15, said end clips and said at least one intermediate clip each having at least two legs defining said space.

17. The removable arch form assembly of claim 16, said at least two legs engaging upper and lower surfaces of said arch form.

18. The removable arch form assembly of claim 9 further comprising at least one fastener extending through said end clips and said at least one intermediate clip.

19. The removable arch form assembly of claim 12, said at least one intermediate clip and said end clips being different sizes.

20. The removable arch form assembly of claim 12, said at least one intermediate clip and said end clips being the same size.

21. A removable arch form assembly, comprising:

an arched structure having a ledge adjacent thereto;

a plurality of arch clips each independently formed having a first leg and a second leg, each of said plurality of arch clips spaced apart from said ledge, each of said arch clips and said ledge defining a space;

a flexible arch form disposed within said space;

wherein said plurality of arch clips and said ledge capture said arch form and removably support said arch form;

at least one grab area located on said flexible arch form for engagement by a tool to remove said arch form from said clips;

said removable arch form assembly having a first configuration wherein said flexible arch form is disposed within said space of said plurality of arch clips and a second configuration wherein said flexible arch form is slidably removed from said plurality of clips upon formation of a masonry arch about said arched structure.

* * * * *